US006816701B2

(12) United States Patent
Saitoh

(10) Patent No.: US 6,816,701 B2
(45) Date of Patent: Nov. 9, 2004

(54) FIXING DEVICE INCLUDING GUIDE UNIT AND IMAGE FORMING APPARATUS

(75) Inventor: Seiji Saitoh, Chiba-ken (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/175,798

(22) Filed: Jun. 21, 2002

(65) Prior Publication Data

US 2003/0007817 A1 Jan. 9, 2003

(30) Foreign Application Priority Data

Jun. 22, 2001 (JP) ..... 2001-190212
May 24, 2002 (JP) ..... 2002-151022

(51) Int. Cl.[7] ..... G03G 15/00
(52) U.S. Cl. ..... 399/406
(58) Field of Search ..... 399/406, 407

(56) References Cited

U.S. PATENT DOCUMENTS 5,187,527 A * 2/1993 Forlani et al. ..... 399/406
5,722,012 A 2/1998 Saitoh
6,002,913 A * 12/1999 Pawlik et al. ..... 399/406
6,104,889 A 8/2000 Saitoh

FOREIGN PATENT DOCUMENTS

JP 8-227188 9/1996
JP 2000-122351 4/2000

* cited by examiner

*Primary Examiner*—Quana Grainger
(74) *Attorney, Agent, or Firm*—Oblon, Spivak, McClelland, Maier & Neustadt, P.C.

(57) ABSTRACT

A fixing device, which is constructed in a way that can easily straighten the curl without increasing cost and can prevent a re-curl generated after the sheet has been straightened, comprises a heat unit and a press unit and an ejecting unit. The heat unit and the press unit dispose a sheet opposite to a midway position of the sheet ejecting/transporting path, wherein the sheet supports a toner image. The toner image is fixed on the sheet by heat and pressure of the heat unit and the press unit, then the sheet is transported to the ejecting unit. The sheet is ejected by the ejecting unit in a way that makes the sheet keep in a condition turned back reverse to a bending direction generated when the sheet is sent out from the heat unit and the press unit.

12 Claims, 5 Drawing Sheets

FIXING DEVICE INCLUDING GUIDE UNIT AND IMAGE FORMING APPARATUS

CROSS-REFERENCE TO RELATED APPLICATION

This application claims the priority benefit of Japanese application serial no. 2001-190212, filed Jun. 22, 2001 and 2002-151022, filed on May 24, 2002.

BACKGROUND OF THE INVENTION

1. Field of the Invention

This invention relates in general to a fixing device and an image forming apparatus, and more specifically relates to a curl straightening structure acting when a sheet is fixed.

2. Description of Related Art

In an image forming apparatus such as a copy machine, a printer, a facsimile or the like, generally after an electrostatic latent image, which is formed on a latent-image-support, is treated in a visualizing-image step of a developing process, the visible image is electrostatic transcribed to a recording medium such as a sheet of a recording paper, and the transcribed visible image is fixed thereon by heat in order to provide a so called copy or record.

A heat roller and a press roller, which face-to-face clamp a sheet-transporting path, are disposed on one of the devices used for fixing, and when these two rollers clamp and transport the sheet, a toner image is fixed by the heat roller with heat and pressure.

The fixing with the heat roller is popular nowadays, due to its advantages, such as achieving high efficiency and high speed in heat roller fixing, and achieving a high conductivity and stability in fixing efficiency, and having simple structures that are capable of using a sheet-transporting medium.

The fixed sheet is ejected to an ejecting tray by an ejecting unit with ejecting rollers, which are disposed near the heat roller and the press roller.

The toner-supporting-face becomes curved with respect to an imaginary center, resulting from the difference of the humidity between the heat roller and the inner face of the toner-supporting-face at the side contacting the heat roller. Then the curved face becomes curled. Once a sheet is curled, problems as follow appear.

In the case when ejecting a sheet in a horizontal direction, and the lower face of the sheet serves as the toner-supporting-face, the sheet will be ejected in a curled condition bending downward, and when it is ejected to an ejecting tray, a tip of the sheet will hang downward, and a jam is caused resulting from the tip protruding and hitting a transporting face of the ejecting tray such that the moving thereof is obstructed.

In order to straighten the curl of a sheet, some conventional structures have been developed as follows: one of the structures is made in such a way that the ejecting rollers, which clamp and transport a sheet, are made face-to-face, and the curvature radius of one of the ejecting rollers is much smaller than that of the other one, so that with the difference in curvature, the sheet will bend in a direction reverse to the direction of the curl during transporting (such as Japanese Laid-Open publication no. He5-162916);

Another one of the structures is made in such a way that one of the transporting guide units is extended in a direction reverse to the direction of the curl, making the sheet, which moves from the transporting guide unit to the other one within the transporting path, imitate the shape of the transporting guide unit, to straighten the curl;

Another one of the structures is made in a way that eliminates the curl with the orientation by making the sheet move along the guide face of the transporting guide;

Another one of the structures is made in such a way that by changing the position where the sheet is clamped and transported in, the transporting direction is changed in order to straighten the curl (such as Japan Laid-Open publication no. He7-121039, He7-285721, He8-137309 and He8-290857);

Another one of the structures in made in such a way that, in order to straighten the curl by using the circumference of the ejecting rollers, make a pair of other rollers contact along the circumferences of the ejecting rollers, then the sheet is clamped and transported by the ejecting rollers and the pair of other rollers, so that the curl of the sheet can be straightened along the circumferences of the ejecting rollers (such as Japanese Patent no. 2547722).

A face of a sheet, which supports the toner image, bends towards the side and causes a curl resulting from the difference of the humidity between the face of the sheet supporting the toner and the face not supporting the toner. Therefore, the conventional curl straightening structure eliminates the curl by loading in a direction reverse to them direction of the curl, to turn the sheet back.

Among the structures that bend the sheet in a direction reverse to the direction of the curl, in the case when using a non-moving guide unit which constructs a transporting path, the tip of the sheet will contact with the guide unit again after it has been straightened during moving, so the tip of the sheet bent reverse to the curl will easily encounter a large resistance during moving, and some failures will happen in transporting.

To solve this problem, the Japanese Patent no. 547722 discloses that, in the case when transporting rollers are used in the sheet-transporting path to straighten the curl, it is necessary to keep the transporting rollers in contact with the ejecting rollers, and it is further necessary to lead the sheet toward the contacting position of the ejecting rollers and the transporting rollers, and therefore the structures are complicated. Especially when the sheet enters the contact position on the ejecting rollers and the transporting rollers, the sheet is separated from the transporting guide unit, and therefore, it is difficult to lead the sheet to the contacting position, so some failures easily happen in transporting as in the case described above.

The conventional structures to straighten the curl in other ways are as follows: one of the structures is that, when clamping and transporting the sheet, which is transported from a fixing device, by a pair of rollers opposed along the transporting path, the sheet is forced with an extension due to the difference in transporting velocity between the rollers. In this condition, the sheet is pressed in a direction reverse to the curl direction with another middle roller, which is disposed between the rollers, to straighten the curl (such as Japanese Laid-Open publication no. He8-227188);

Another one of the structures is that the sheet ejected from the fixing device is clamped by the ejecting rollers and a pair of other rollers, which are disposed along the circumferences of the ejecting rollers of the ejecting unit, and the sheet is turned around in a direction reverse to the direction of the curl with the roller upstream of moving sheet, and then after making the sheet move imitating the circumferences of the ejecting rollers, eject the sheet during it is clamped again by the ejecting rollers and the other rollers (such as the Japanese Laid-Open publication no. 2000-122351).

However, these curl straightening structures disclosed in publications have problems as follows.

For straightening the curl, it is necessary to bend the sheet in a direction reverse to the curl, and it is also necessary to make the sheet have no inclination to curl again after it has been straightened. The flexural rigidity, the so called strength of the waist, is important. However, the publications described above disclose the curl straightening, but disclose nothing about structures preventing the sheet from re-curling during transport after the sheet is curl-straightened. Especially, as in Japanese Laid-Open publications no. He8-227188 and 2000-1223551, they relate nothing about turning around the sheet to the direction reverse to the curl, and they only disclose bending the sheet in a direction the same as the re-curl with the transporting unit during the ejecting of the sheet.

SUMMARY OF THE INVENTION

To solve the problems of the conventional fixing device described above, the aim of the present invention is to provide a fixing device and an image forming apparatus, which are constructed in such a way that can easily straighten the curl without increasing cost and can prevent sheet re-curling from being generated after the sheet has been straightened.

The fixing device of the present invention comprises: a heat unit and a press unit, disposing a sheet opposite to a midway position of the sheet ejecting/transporting path, wherein the sheet supports a toner image; and an ejecting unit, wherein the toner image is fixed on the sheet by heat and pressure of the heat unit and the press unit, then the sheet is transported to the ejecting unit, and the sheet is ejected by the ejecting unit in a way that makes the sheet keep in a condition turned back reversed to a bending direction generated when the sheet is sent out from the heat unit and the press unit.

The fixing device of the present invention further features that on the sheet ejecting/transporting path, a position opposite to the heat unit and the press unit serves as a starting point, and a position, which is set along the bend direction, and on which the ejecting unit is disposed in a way that turning back the sheet ejecting/transporting path reverse to the bending direction, serves as an ending point, and the transporting guide unit is set on a position changing the transporting path from the bending direction to a reverse direction, and the sheet is kept in a condition with turning back when moving by the transporting guide unit in a way that the sheet moves to the starting point of the sheet ejecting/transporting path, the transporting guide unit and the ending point in sequence.

The fixing device of the present invention further has the feature that the sheet is ejected by the ejecting unit in a condition turning back reversed to the bending direction, and the transporting guide unit is set to turn back the sheet in such a way that the transporting guide unit is positioned so that it does not cross a connecting line from a clamping position of the sheet on the ejecting unit.

The fixing device of the present invention further has the feature that the transporting guide unit is set close to or apart from the sheet ejecting/transporting path.

The fixing device of the present invention further has the feature that the transporting guide unit is forced toward the sheet ejecting/transporting path by an elastomer, and moves to a position not crossing a connecting line from a sheet clamping position on the ejecting unit when the transporting guide unit faces the sheet.

The fixing device of the present invention further has the feature that the transporting guide unit is constructed with small sliding-friction resistance with respect to the sheet.

The fixing device of the present invention further has the feature that the transporting guide unit is constructed with a roller.

The fixing device of the present invention further has the feature that the transporting guide unit is constructed with a guide plate with a rib shape having a face contacting with the sheet with low friction resistance.

The fixing device of the present invention further has the feature that the plurality of ejecting units is disposed to move the sheet in a condition turning back the sheet reverse to a bending direction and perpendicular to an ejecting direction of the sheet, and increase a flexural rigidity of the sheet, which is guided by the transporting guide unit, in a way to make the sheet have a habit of bending reversed to a curl direction in the ejecting direction.

The ejecting unit clamps the sheet ejecting/transporting path, and has a first ejecting unit and a second ejecting unit, wherein the first ejecting unit, which faces a toner-image-supporting face of the sheet, has a length longer than that of the second ejecting unit in a direction perpendicular to the ejecting direction, and a flange portion formed at each of the ends of the first portion has a diameter larger than that on the other circumference of the first ejecting unit, and the second ejecting unit is oppositely in contact with the first ejecting unit between the flange portions.

The image forming apparatus of the present invention comprises the fixing device described as above.

BRIEF DESCRIPTION OF THE DRAWINGS

While the specification concludes with claims particularly pointing out and distinctly claiming the subject matter which is regarded as the invention, the objects and features of the invention and further objects, features and advantages thereof will be better understood from the following description taken in connection with the accompanying drawings in which:

DESCRIPTION OF THE PREFERRED EMBODIMENT

The embodiments of the present invention are explained with the diagrams as follows.

Figure 1:
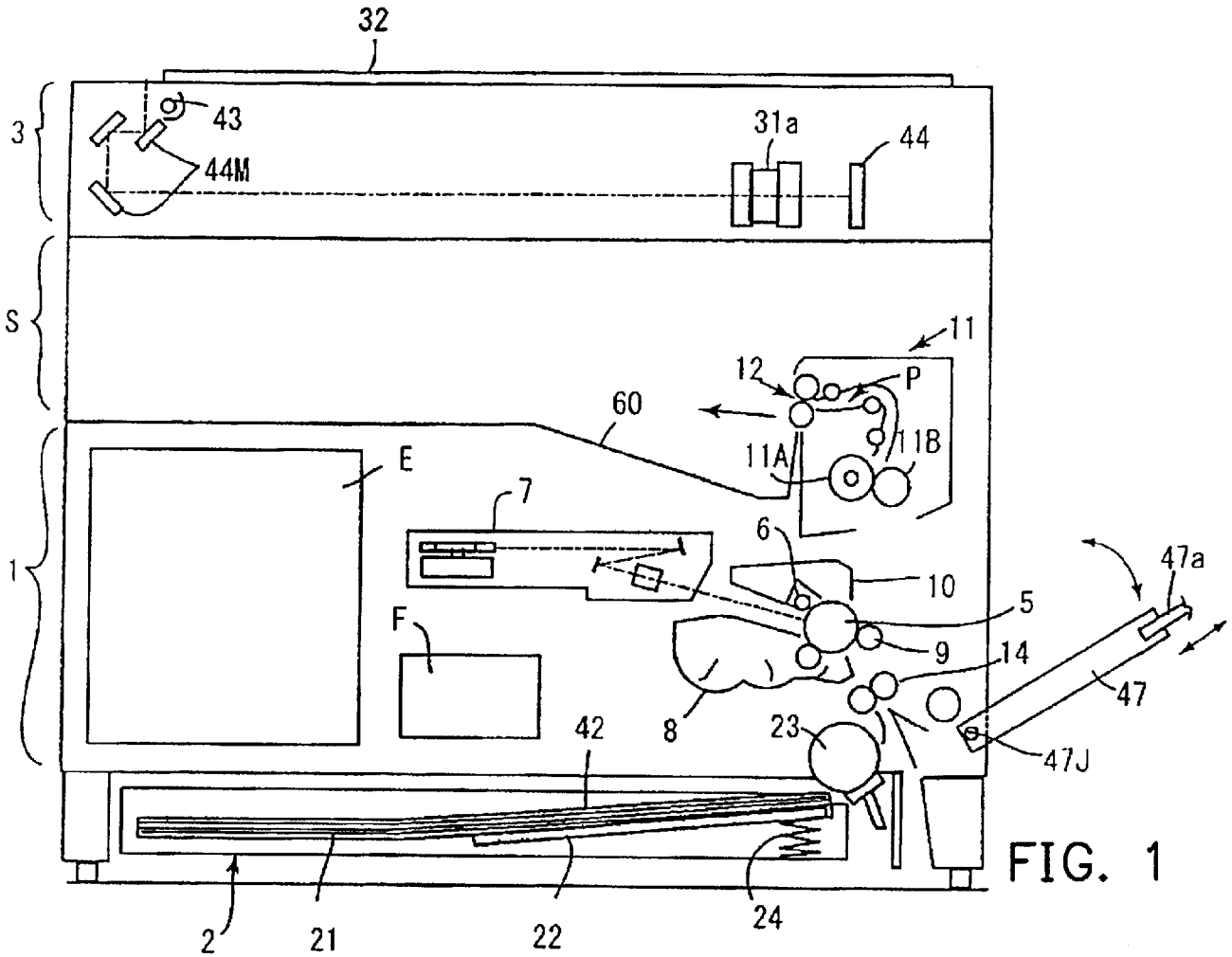
FIG. 1 shows an image forming apparatus, in which a fixing device is used, according to the embodiment of the present invention.

FIG. 1 is a view showing an example of a paper-ejecting device used by the image forming apparatus according to the present invention. Though the image forming apparatus, shown as FIG. 1, combines functions of a copying machine and a printer, it is not limited to have such combination functions, it can have either function alone.

In the image forming apparatus, shown in FIG. 1, an image reading unit 3, which reads an image of a document, is disposed at an upper portion of the image forming apparatus 1, and an image forming portion 1 that is separated by a space S from the image reading unit 3 is disposed at about a central position at (see FIG. 1) apart from the lower portion of the image reading unit 3. A paper feeding unit 2, which feeds paper such as a sheet, is disposed at the lower portion of the image forming apparatus 1.

On the image forming apparatus shown as FIG. 1, in order to feed papers in a manual way, a manual paper feeding platform 47 capable of freely opening and closing is set at a right side of the image forming apparatus 1.

The manual paper feeding platform 47 is generally accepted inside the image forming apparatus 1, and it rotates down centered on a pivot 47J on demand. Then an assistant platform 47*a*, which is accepted inside the manual paper feeding platform 47, is drawn out from the tip-end of the manual paper feeding platform 47.

In the image forming apparatus 1, a charging device 6, an exposure device 7, a developing device 8, a transcribing device 9 and a cleaning device 10 etc. are disposed surrounding the drum-shaped photosensor 5, serving as an image carrier. The charging device 8 is used for charging the surface of the photosensor 5. The exposure device 7 uses a laser beam to irradiate an image information on the surface of the photosensor 5. The developing device 8 visualizes the electrostatic latent image, which is exposed to be formed on the surface of the photosensor 5. The transcribing device 9 transcribes the toner image developed on the photosensor 5, to a paper 42. The cleaning device 10 eliminates and recycles the toner residual on the surface of the photosensor 5 after it has been transcribed.

The paper feeding unit 2 has a paper feeding cassette 21 mainly for loading and accepting unused sheets such as paper (sheets, hereinafter) 42.

Used paper can be also set inside the paper feeding cassette 21. The paper feeding cassette 21 is detachable from the front-side of the image forming apparatus 1, and therefore operational property for adding papers is very good. A bottom plate 22, which rotatably supports the paper feeding cassette 21, loads the sheets 42, and the sheet 42 at the most upper position is pressed by a spring 24 so as to be pressed to a paper feeding roller 23.

Once an image-forming command is sent to the paper feeding unit 2, the sheet 42 at the most upper position will be sent toward a resist roller 14, which is set at a side of the transcribing position (the position of the transcribing device 9), from the paper feeding cassette 21 by rotating paper feeding roller 23. The transcribed sheet 42 will be temporarily stopped by the resist roller 14, then the position relationship of the toner image on the photosensor 5 and the tip of the sheet 42 is set to a preset position to transfer the sheet 42 by a set timing, and the toner image will be copied when it passes the transcribing unit.

In order to read and scan the document (not shown) put on a contact glass 32, the movable reading unit 31, which comprises a light source 43 for illuminating the document and mirrors 44M, moves back and forth in the image reading unit 3. With the movable reading unit 31, the image information is read as image signals by an electro-optical converting element 44 (such as CCD etc.) disposed at the back side of a lens 31*a*. The image signals corresponding to the read image information are digitized and treated by an image process. In the image reading unit 3, the electrostatic latent image is formed on the surface of the photosensor 5 with a beam emitted by a laser diode (not shown) of the exposure device 7 according to the image-treated signals. That is, the light signal from the laser diode arrives at the photosensor 5 through well-known polygon mirrors or lens to form an electrostatic latent image on the photosensor 5. The electrostatic latent image moves as the photosensor 5 rotates, and is visualized by the toner fed from the developing device 8, and then the electrostatic latent image moves toward the transcribing device 9. An automatic document carrier (not shown), which automatically transports the document onto the contact glass 32, is installed above the image reading unit 3. The automatic document carrier is detachable, and can be optionally installed on the image forming apparatus 1.

A paper-ejecting tray 60, which accepts a sheet 42 ejected from a fixing device 11 after it has been fixed, is arranged in the space S. When the sheet is finished being copied and passes to the fixing device 11, the toner image is fixed onto the sheet, and at an interval passing the fixing device 11 from the paper feeding unit 2 until the paper is ejected, the curl of the sheet due to the sheet ejecting/transporting path P described as follows is straightened and the sheet arrives to the ejecting unit 12.

Figure 2:
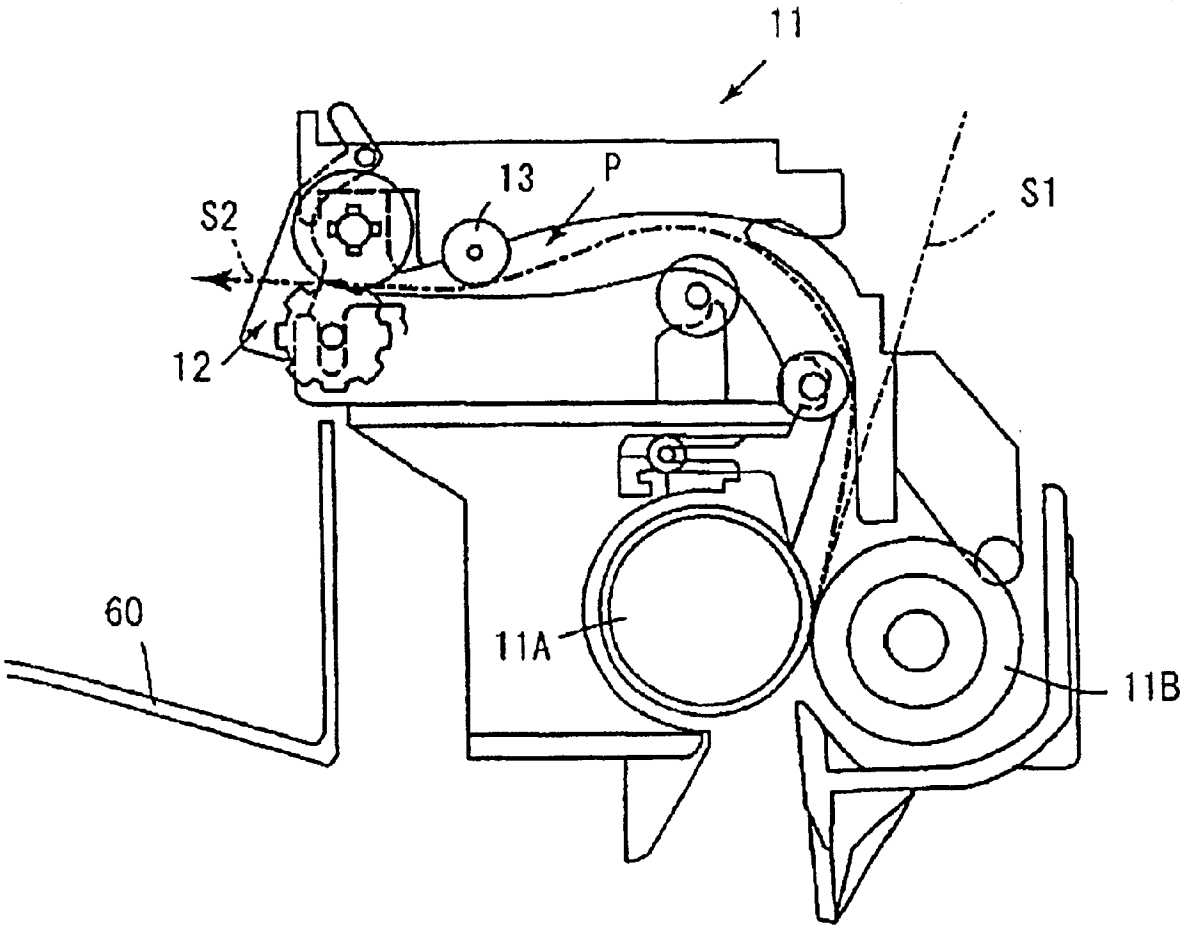
FIG. 2 is a view showing the main structures of the fixing device according to the embodiment of the present invention.

The fixing device 11 is detailed shown in FIG. 2.

In FIG. 2, a heat roller 11A and a press roller 11B are disposed inside a frame of the fixing device 11.

The heat roller 11A comprises a hollow cylinder and a roller. The roller has a separation layer on the surface of the hollow cylinder, and the hollow cylinder is made of a material of good conductance and is disposed on the side in contact with the toner image transported on the sheet. A hot source (not shown) is disposed inside the heat roller 11A.

The press roller 11B has an elastomer layer formed on the surface of the core bar, and it is pressed and connected to the heat roller 11A while it rotates and moves with the heat roller 11A, and in this way, a fixing nip portion is formed when clamping and transporting the sheet.

The toner image transported on the sheet is heated to fix by the heat and pressure when it is clamped and transported by the heat roller 11A and the press roller 11B.

The sheet ejecting/transporting path P is set in the frame of the fixing device 11, wherein a position opposite to the heat roller 11A and the press roller 11B serves as a starting point of the sheet ejecting/transporting path P.

The sheet ejecting/transporting path P has the starting point at the position opposite to the heating roller 11A and the press roller 11B, and has an ending point that extends upward along the connecting line S1 at the position opposite to the two rollers 11A, 11B and then changes to about a horizontal direction in a way that turns back on a midway position of the extension portion along the curl direction created on the sheet. A paper ejecting unit 12 using a pair of rollers is disposed at the ending point. That is, the sheet ejecting/transporting path P is formed in a way that it extends from the starting point to the ending point, wherein the paper ejecting unit 12 is set along the bending direction of the sheet 42 and is set to turn back in a direction reverse to the bending direction.

The sheet ejecting/transporting path P has a curvature radius larger than that of the curl at a portion from the starting point to the turning back portion, and then it will not encourage the happening of the curl. Therefore, the extending portion of the sheet ejecting/transporting path P extends to a portion upward from the opposite position of the rollers, the portion extending along the bending direction of the curl and turns back is upward from the paper ejecting unit 12. A transporting guide unit 13, which is constructed by the roller at a side of the ejecting unit 12 on the moving direction of the sheet, is set from the upper position to the ejecting unit 12 at the ending point.

The transporting guide unit 13 is disposed in a way that guides the sheet to a direction opposite to the curl direction in the transporting path from the portion extending along the curl direction of the sheet ejecting/transporting path P to the paper ejecting unit 12.

In FIG. 2, the transporting guide unit 13 can be disposed opposite to the sheet facing the inner side of the toner-supporting face, in the condition that the transporting guide unit 13 can bend the sheet opposite to the direction of the sheet ejecting/transporting path P, which turns back at a place upward from the ejecting unit 12. Therefore, in the sheet ejecting/transporting path P, the sheet 42 moves to an opposite portion of the heat roller 11A and the press roller 11B, the transporting guide unit 13 and the ejecting unit 12 in sequence, through the transporting guide unit 13. In other words, the sheet extends upward from the starting point, and bends to the side opposite to the curl direction at a back portion of turning back, and then arrives the ejecting unit 12 at the ending point.

Figure 3A:
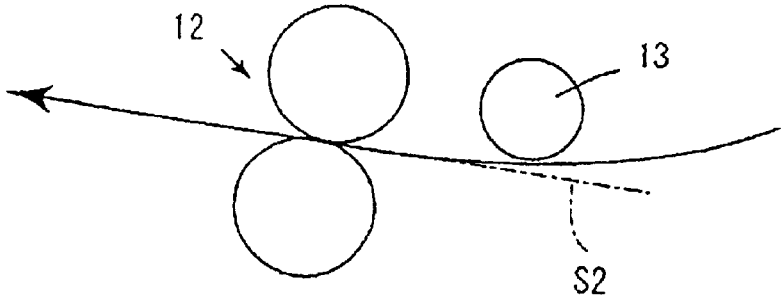
FIG. 3A is a view showing the disposing of the ejecting unit and the transporting guide unit in the fixing device of FIG. 2.
Figure 3B:
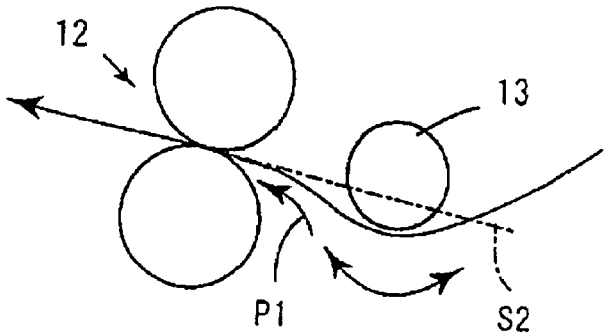
FIG. 3B(PRIOR ART)
FIG. 3B is a view showing the disposing of the ejecting unit and the transporting guide unit of the prior art.

The transporting guide unit 13, as shown in FIG. 3A, is disposed at a position lower than the connecting line S2 at the paper ejecting unit 12 disposed at the ending point of the sheet ejecting/transporting path P that extends on about a horizontal direction. In this way, it can stop the sheet from being curved upward and being clamped by the paper ejecting unit 12, and then it can prevent the sheet from a transporting condition (as shown as the arrow P1 in FIG. 3B) that curls again in the same direction.

With the structures according to the present embodiment, the sheet, which is clamped and transported by the heat roller 11A and the press roller 11B after it has been heated and fixed, moves along the sheet ejecting/transporting path P. At this time, the sheet, which passes the clamping-transporting position of the heat roller 11A and the press roller 11B, moves to the position of the transporting guide unit 13 along the curl direction on the midway position of the sheet ejecting/transporting path P.

The sheet, which arrives at the transporting guide unit 13, is guided into the paper ejecting unit 12 in a bending direction set opposite to the direction up until now, then it is clamped and transported to generate a tension with the paper ejecting unit 12, the curl is straightened in a way that the sheet is bent by the ejecting unit 12 and the transporting guide unit 13 in a direction opposite to the curl direction. The sheet, which is bent opposite to the curl direction at the position of the transporting guide unit 13, keeps the condition of being turned back to a direction reverse to the curl direction. Then the sheet is guided into the ejecting unit 12 due to the disposing relationship of the transporting guide unit 12 with respect to the ejecting unit 12 (the transporting guide unit is disposed at a portion not crossing the connecting line S2). Therefore, when the sheet is guided into the ejecting unit 12, it will not be curled and will not be bent in the same direction again. After the sheet is straightened, the sheet can be prevented from being curled again.

With the structures according to the present embodiment, at an interval from the position opposite to the heat roller 11A and the press roller 11B to the position where the sheet arrives at the ejecting unit 12, the transported sheet 42 is bent opposite to the curl direction only by facing the transporting guide unit 13, which is disposed at a position not crossing the connecting line on the ejecting unit 12. Then the sheet 42 is contained in such a condition to be ejected by the ejecting unit 12. The present invention is different from the structure in the Japanese Laid-Open No. H08-227188 and 2000-123551, whose sheet is ejected by the ejecting unit after it is turned back. In the present invention, the sheet will not be bent again with the ejecting unit, and can be ejected in a curl-straightened way. It is desired that the transporting guide unit is not limited to a roller described above, it can be a guide plate with a rib shape, which is disposed at a suitable place in a width direction of the sheet 42 that is perpendicular to the moving of the sheet 42. In this condition, the guide plate with a rib shape, in which faces in contact with the sheet have low friction coefficients, can be made of a resin material, such as polyamide or Derlin.

Another embodiment related to the present invention is described as follows.

Figure 4:
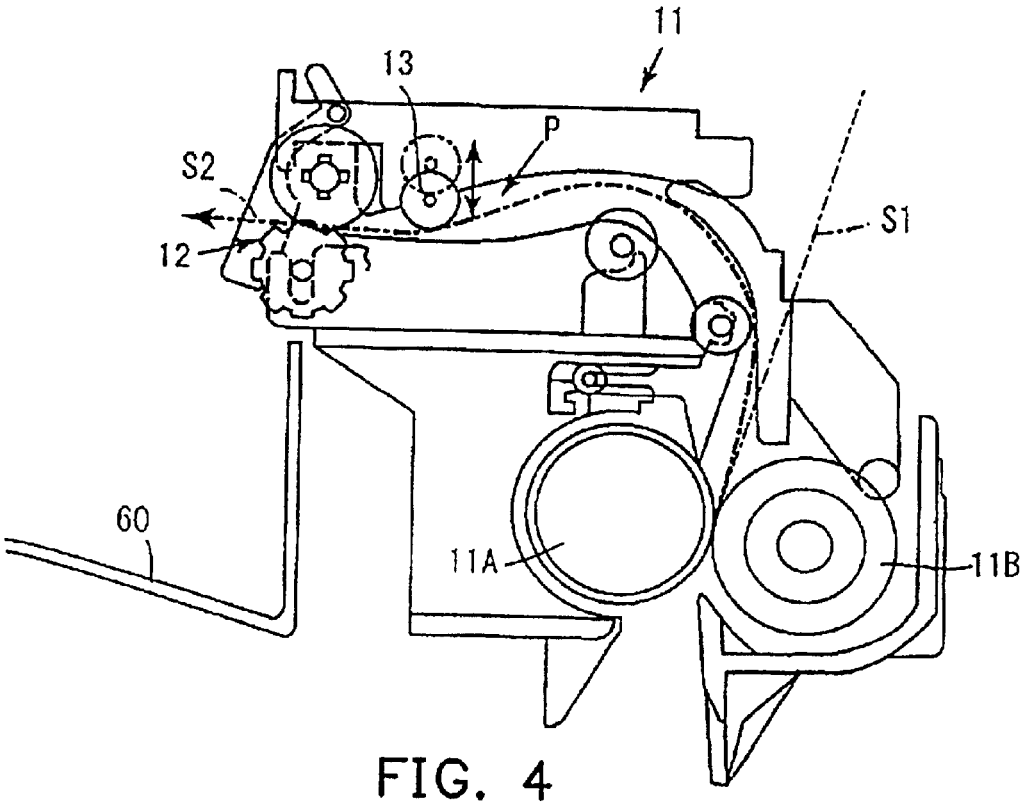
FIG. 4 is a view showing the main structures of the fixing device according to another embodiment of the present invention.

The embodiment shown in FIGS. 4 and 5 have the feature that the transporting performance is improved when leading the sheet into the ejecting unit 12.

In FIG. 4, the transporting guide unit 13 can be set close to or apart from the transporting path from the sheet ejecting/transporting path at a position, which is turned back, to the ending point, in which the ejecting unit 12 is positioned. In the case when the transporting guide unit 13 faces and is in contact with the sheet 42, as shown in FIG. 2, the transporting guide unit 13 is not positioned under the connecting line S2 of the ejecting unit 12 and it is positioned toward not crossing the connecting line S2 and apart from the transporting path of the sheet 42. In the case when the transporting guide unit 13 does not face the sheet 42, it is positioned close to the transporting path of the sheet 42.

Figure 5A:
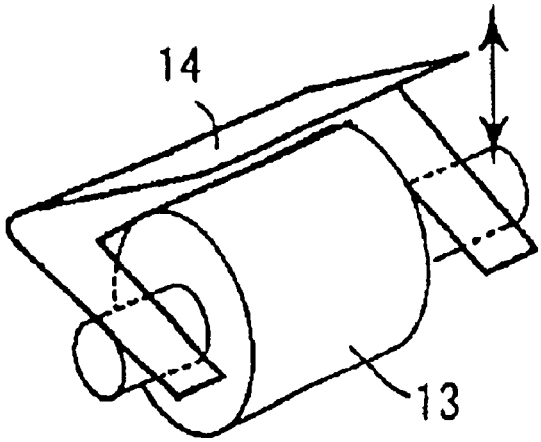
FIG. 5 is a view showing supporting structures of the transporting guide unit used in FIG. 4.
Figure 5B:
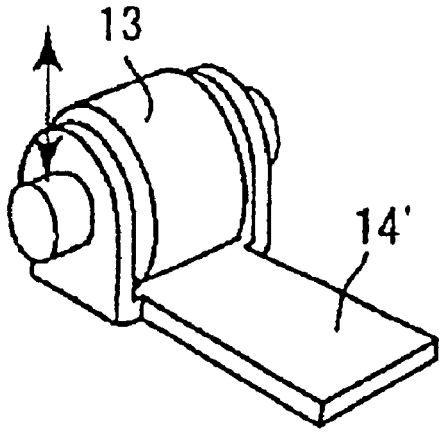

The transporting guide unit 13 shown as FIG. 5 is positioned in contact with the sheet 42 in such a way as to support the shaft by supporting units 14 (see FIG. 5A), 14' (see FIG. 5B) which are made of elastic material, such as plate springs, and forces the shaft toward close the transporting path.

In this embodiment, the change of the stretching of the sheet 42 serves as a driving force when the transporting guide unit 13 is apart from the transporting path. When the tip of the sheet 42 is clamped and transported by the ejecting unit 12, the tip of the sheet 42, which is forced by the transporting guide unit 13 in a direction to eliminate the curl, is clamped and stretched, and then the transporting guide unit 13 is pressed upward. Therefore, the transporting guide unit 13 can continuously act with a curl-straightening force to the sheet 42 by adding a recovering force to the contrary face, which can be apart from the position without crossing the connecting line S2 of the ejecting unit 12, from the position close to the transporting path. The arrow in FIG. 5 shows the changing direction of the transporting guide unit 13.

With the structures described above in this embodiment, the sheet 42, which is turned back in the sheet ejecting/transporting path and arrives at the transporting guide unit 13, is led into the ejecting unit 12 in a direction opposite to the curl by the transporting guide unit 13. Then the sheet 42 is stretched by the ejecting unit 12 and the transporting guide unit 13 to eliminate the curl.

The bending direction of the sheet 42, which is clamped and transported by the ejecting unit 12, is switched by the transporting guide units 13. In this way, the sheet 42 is stretched between the transporting guide units 13. Once the sheet 42 is stretched, the transporting guide unit 13, which is positioned and bent in a direction different from the transporting direction up until now, turns to be resistant against the transporting of the sheet 42. Therefore, in this embodiment, the sheet 42 is stretched between the clamped positions, the clamped position of the heat roller 11A and the press roller 11B and the clamped position of the ejecting unit 12. By using the stretch between the clamped positions, the transporting guide unit 13 can be apart from a curl-straightened position without crossing the connecting line S2 of the ejecting unit 12. With this structure, when acting a load larger than the load generated as the sheet 42 is bent in a curl-straightened direction by the transporting guide unit 13 with steps that the sheet is clamped by the ejecting unit 12, the transporting guide unit 13 can be further apart from the curl-straightened position, the transporting resistance can thus be reduced and the damage resulting from increasing the extension of the sheet can be prevented.

Still another embodiment related to the present invention is described as follows.

Figure 6:
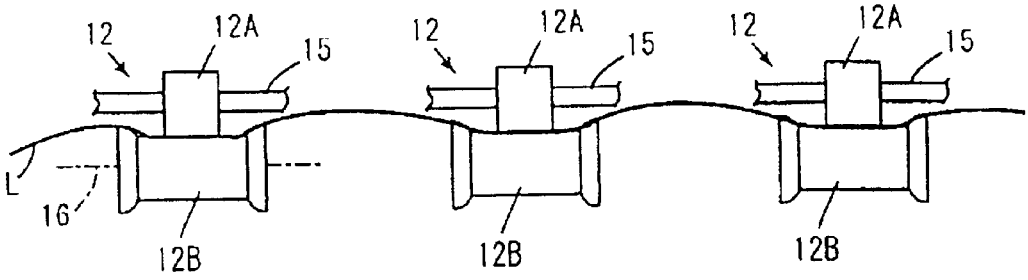
FIG. 6 is a view showing the ejecting unit used in the fixing device according to still another embodiment of the present invention.
Figure 7:
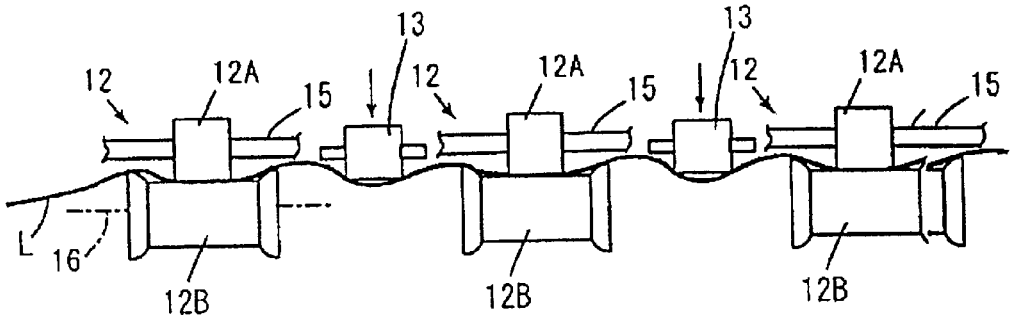
FIG. 7 is a front view showing the disposing of the ejecting unit and the transporting guide unit of the fixing device.
Figure 8:
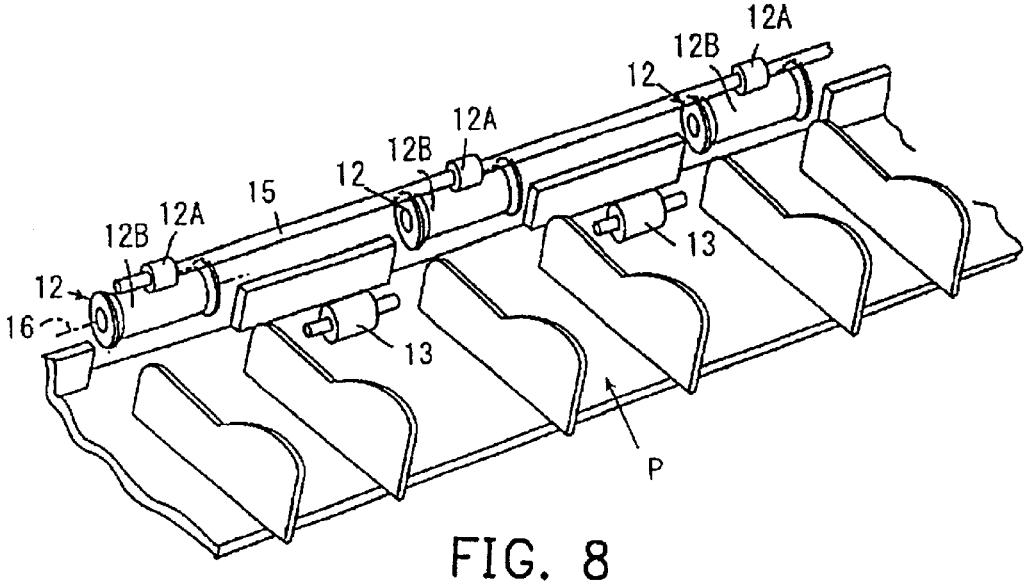
FIG. 8 is a perspective view of the FIG. 7.

The embodiment shown from FIG. 6 to FIG. 8 has the feature that the re-curl can be prevented in the case when the sheet with high rigidity is ejected from the ejecting units 12.

In FIG. 6, the ejecting units 12 are constructed by a pair of rollers, which oppose each other and are rotatably supported in the axial directions of the shaft 15, 16 (for convenience, only the numeral 16 is shown in one of the ejecting units 12, and all the ejecting units 12 are of the same structure), wherein the axial directions are parallel to the width direction, which is perpendicular to the ejecting direction of the sheet L.

The roller 12A of the rollers constructing the ejecting unit 12 is made of gum, and the roller 12B is made of resin or gum with a length longer than that of the roller 12A in the axial direction.

A flange portion is formed at each of the two ends of the roller 12B with a diameter larger than that of the body positioned between the two ends of the roller 12B. When the rollers 12A and 12B clamp and transport the sheet L, a portion of the sheet L can be loaded on the flange. Therefore, the sheet is flapped in the width direction perpendicular to the ejecting direction, and therefore the flexural rigidity of the sheet in the ejecting direction is increased, so as to prevent the sheet from curling in the ejecting direction (curl).

FIG. 7 shows the structure of the embodiment, the transporting guide unit 13 is set between the rollers 11A, 11B, which construct the ejecting unit 12 in the axial directions of the shaft 15, 16. The transporting guide unit 13, which is the same as shown in FIG. 2, is positioned in a way such that it will not be lower than the connecting line (the numeral S2 in FIG. 2) of the ejecting unit 12. FIG. 8 is a perspective view of FIG. 7.

With the structures of this embodiment described above, because the flexural rigidity of the sheet is increased by the structures of the ejecting units 12 and the transporting guide units 13, the re-curl generated in the ejecting direction when the sheet is ejected can be prevented. Especially, the increase of the flexural rigidity due to the ejecting units 12 can enhance the effect of preventing the curl from occurring, which curls toward the toner-image-supporting face, due to the roller 12B positioned at the side of the toner-image-supporting face. Therefore, the curl of the inner and outer surfaces of the sheet can be prevented.

With the structures described in claim 1, because the sheet sent out after being fixed can be kept in a turning back condition that is reverse to the bending direction generated on the sheet so as to eject the sheet by the ejecting unit, the curl-straightened sheet will not be bent in the same direction again. In this way, the curl created by the ejecting unit can be prevented.

With the structures described in claim 2, because the sheet is bent only by the transporting guide unit, which turns back the sheet reverse to the bending direction when moving the sheet, the sheet will not be bent by the opposite unit after it has been bent. In this way, the curl-straightened sheet can be prevented from being curled again.

With the structures described in claim 3, because the sheet can be turned back in the case when the transporting guide unit is positioned not crossing the connecting line of the ejecting unit, the two bending directions, the bending direction on the turning back position and the bending direction on the ejecting unit, which is positioned passing the turning back position, will not be generated. In this way, once the sheet is bent reverse to the direction of the curl, it doesn't needed to be bent again.

With the structures described in claims 4 and 5, because the transporting guide unit can be close to or apart from the transporting path, especially as to the structure in claim 5, the transporting guide unit can be apart from the position without crossing the connecting line of the ejecting unit in the case when the transporting guide unit is forced by the elastomer and opposite to the sheet, the sheet can be turned back and curl-straightened, and in the case when the sheet is abnormally loaded, and can move to the position for preventing damage due to increasing the extension of the sheet.

With the structures described from claim 6 to claim 8, because the transporting guide unit is constructed with low sliding-friction-resistance, and the rollers as claim 7 can be in contact with the sheet with guide plates having low friction coefficients described as claim 8, the transporting resistance to the sheet can be prevented from increasing and the sheet will not be damaged.

With the structures described in claim 9 and claim 10, because the flexural rigidity of the sheet itself can be increased, the curl generated when the sheet passes the ejecting unit after it has past the transporting guide unit can be prevented, and the sheet can be kept in a curl-straightened condition in the ejecting unit.

With the structures described in claim 11, after being fixed, because the curl created on the sheet moving to the ejecting unit can be removed by the transporting guide unit and the sheet can be moved to the ejecting unit kept in the condition that the curl is removed by the transporting guide unit, the sheet ejected after being fixed will not curl so that the jam can be prevented.

While the present invention has been described with a preferred embodiment, this description is not intended to limit our invention. Various modifications of the embodiment will be apparent to those skilled in the art. It is therefore contemplated that the appended claims will cover any such modifications or embodiments as fall within the true scope of the invention.

What claimed is:

1. A fixing device, comprising:

a heat unit and a press unit defining an initial portion of a sheet path, the heat unit and the press unit configured to fix an image on a sheet;

an ejecting unit defining an end portion of the sheet path, the ejection unit configured to clamp the sheet in a nip region and to eject the sheet in a first direction; and a transporting guide unit disposed entirely above a line extending through the nip region along the first direction, the transporting guide unit defining a middle portion of the sheet path.

2. The fixing device of claim 1, wherein the transporting guide unit is configured to curl the sheet in a direction opposite to a curl imparted by the heat unit and the press unit.

3. The fixing device of claim 1, wherein the transporting guide unit and the ejecting unit are configured to curl the sheet in a direction opposite to a curl imparted by the heat unit and the press unit.

4. The fixing device of claim 1, wherein the transporting guide unit is positionable adjacent and apart from the sheet path.

5. The fixing device of claim 4, further comprising:

an elastomer configured to urge the transporting guide unit adjacent to the sheet path.

6. The fixing device of claim 1, wherein the transporting guide unit comprises a surface having a sliding-friction resistance less than that of the sheet.

7. The fixing device of claim 6, wherein the transporting guide unit comprises a roller.

8. The fixing device of claim 6, wherein the transporting guide unit comprises a guide plate with a rib shape having a face configured to contact the sheet.

9. The fixing device of claim 1, further comprising:

a plurality of ejecting units configured to curl the sheet in a direction opposite to a curl imparted by the heat unit and the press unit.

10. The fixing device of claim 9, wherein the ejecting unit comprises:

a first ejecting unit and a second ejecting unit, the first ejecting unit configured to face the image on the sheet and having a length longer than that of the second ejecting unit in a direction perpendicular to the first direction; and flange portions formed at ends of the first ejecting unit, wherein the flange portions have a diameter larger than a circumference of the first ejecting unit.

11. An image forming apparatus comprising the fixing device of claim 1.

12. A fixing device, comprising:

a heat unit and a press unit, disposing a sheet opposite to a midway position of a sheet ejecting/transporting path, wherein the sheet transports a toner image; and an ejecting unit, wherein the toner image is fixed on the sheet by heat and pressure of the heat unit and the press unit, then the sheet is transported to the ejecting unit, wherein the ejecting unit is configured to curl the sheet in a direction opposite to a curl imparted by the heat unit and the press unit, wherein the transporting guide unit is set close to or apart from the sheet ejecting/transporting path, and wherein the transporting guide unit is forced toward the sheet ejecting/transporting path by an elastomer, and moves to a position not crossing a connecting line from a sheet clamping position on the ejecting unit when the transporting guide unit faces the sheet.

* * * * *